US009074414B1

(12) United States Patent
Steffi

(10) Patent No.: US 9,074,414 B1
(45) Date of Patent: Jul. 7, 2015

(54) ROLL UP GUARD CURTAIN

(76) Inventor: John Steffi, Athens, GA (US)

( * ) Notice: Subject to any disclaimer, the term of this patent is extended or adjusted under 35 U.S.C. 154(b) by 357 days.

(21) Appl. No.: 13/080,869

(22) Filed: Apr. 6, 2011

(51) Int. Cl.
*A47H 1/00* (2006.01)
*E06B 9/66* (2006.01)
*E06B 9/58* (2006.01)

(52) U.S. Cl.
CPC .... *E06B 9/66* (2013.01); *E06B 9/58* (2013.01)

(58) Field of Classification Search
CPC ..... E06B 9/66; E06B 9/58; E06B 9/54
USPC ..... 160/31, 267.1, 274, 310, 311, 321, 322, 160/320, 27, 28, 99, 100, 265, 270, 271, 160/272
See application file for complete search history.

(56) References Cited

U.S. PATENT DOCUMENTS

| | | | | | |
|---|---|---|---|---|---|
| 527,401 | A * | 10/1894 | Bittle | 160/28 |
| 929,742 | A * | 8/1909 | Wilson | 160/322 |
| 1,188,698 | A * | 6/1916 | Stewart | 160/99 |
| 1,811,111 | A * | 6/1931 | Boothman | 160/122 |
| 4,201,189 | A * | 5/1980 | Saunders | 126/630 |
| 4,601,320 | A * | 7/1986 | Taylor | 160/271 |
| 5,048,588 | A * | 9/1991 | Weishar et al. | 160/265 |
| 5,129,442 | A * | 7/1992 | Warner | 160/271 |
| 5,139,074 | A * | 8/1992 | Warner | 160/271 |
| 5,159,967 | A * | 11/1992 | Ashley et al. | 160/265 |
| 5,170,833 | A * | 12/1992 | Taylor et al. | 160/310 |
| 5,222,541 | A * | 6/1993 | Hornberger | 160/265 |
| 5,271,448 | A * | 12/1993 | Delgado | 160/265 |
| 5,353,859 | A * | 10/1994 | Oltahfer et al. | 160/310 |
| 5,620,039 | A * | 4/1997 | Delgado et al. | 160/265 |
| 5,657,805 | A * | 8/1997 | Magro | 160/133 |
| 5,758,705 | A * | 6/1998 | Wagner et al. | 160/310 |
| 5,850,865 | A * | 12/1998 | Hsieh | 160/310 |
| 6,145,571 | A * | 11/2000 | Snyder | 160/264 |
| 6,530,863 | B2 * | 3/2003 | Balli et al. | 475/149 |
| 7,810,544 | B2 * | 10/2010 | Spiess | 160/242 |
| 8,299,734 | B2 * | 10/2012 | Mullet et al. | 318/255 |
| 2002/0139491 | A1 * | 10/2002 | Langenbach | 160/270 |
| 2005/0211391 | A1 * | 9/2005 | Varley et al. | 160/67 |
| 2005/0247412 | A1 * | 11/2005 | Bengtsson et al. | 160/265 |
| 2006/0042765 | A1 * | 3/2006 | Varley et al. | 160/310 |
| 2006/0118253 | A1 * | 6/2006 | Slusarski et al. | 160/271 |
| 2008/0017330 | A1 * | 1/2008 | Tyrode | 160/310 |
| 2012/0261081 | A1 * | 10/2012 | Curtis et al. | 160/133 |

* cited by examiner

*Primary Examiner* — Katherine Mitchell
*Assistant Examiner* — Johnnie A Shablack
(74) *Attorney, Agent, or Firm* — Crose Law LLC; Bradley D. Crose

(57) ABSTRACT

A roll up guard curtain is disclosed having: a vertical frame structure having a base configured for a floor surface, first and second side supports each coupled to an opposing end of the base, perpendicular to the base, and extending upwardly, and an opening defined as a planar area within the frame structure between the first and second side supports and the base; a drum disposed within the base; a curtain disposed upon the drum and configured to extend upwardly from the drum by a curtain bar and retract downwardly to the drum; and a drive mechanism configured to extend rapidly the curtain upwardly from the floor surface and retract rapidly the curtain downwardly to the floor surface, to vertically raise and lower the curtain within the vertical frame structure, thereby to fill the opening when extended and to provide a rapidly extendable and retractable protective barrier.

8 Claims, 16 Drawing Sheets

ROLL UP GUARD CURTAIN

FIELD OF THE INVENTION

The technology described herein relates generally to the fields of safety devices, barrier protecting devices, and retractable curtains. More specifically, the technology described herein relates to an improved roll up guard curtain to protect a worker in an enclosed work area.

BACKGROUND OF THE INVENTION

Protection barrier devices provide protection in manufacturing environments, for example, to protect a worker from potentially hazardous processes. By way of example, a protection barrier device can shield a factory worker from welding sparks, arc rays, and automated equipment.

Related patents and published patent applications known in the background art include the following: U.S. Pat. No. 6,145,571, issued to Snyder on Nov. 14, 2000, which discloses a rolling barrier having a curtain formed of fabric or other material that rolls onto and off of a tube preferably disposed above a doorway or opening to, respectively, block and unblock the opening, the edges of the curtain are received within guideways disposed laterally of the curtain, and which guide the curtain edges to maintain the curtain in a planar orientation during travel; barricade members extending across the curtain (and thus the opening when the barrier is in the closed or blocking position) have their ends disposed in the guideways as well to reinforce the curtain and prevent personnel or objects from passing through the opening at least when the barrier is in the closed position. The barrier may also include a detector for detecting when the door is in or at least approaching the fully closed position and coupled to other electronics to control or regulate operation of the enclosed machine.

The foregoing patent information reflects the state of the art of which the inventor is aware and is tendered with a view toward discharging the inventor's acknowledged duty of candor in disclosing information that may be pertinent to the patentability of the technology described herein. It is respectfully stipulated, however, that the foregoing patent and other information do not teach or render obvious, singly or when considered in combination, the inventor's claimed invention.

BRIEF SUMMARY OF THE INVENTION

In various exemplary embodiments, the technology described herein provides an improved roll up guard curtain to protect a worker in an enclosed work area as a protective barrier device.

In one exemplary embodiment, the technology described herein provides a roll up guard curtain. The roll up guard curtain includes: a vertical frame structure having a base configured for disposition on a floor surface, a first side support and a second side support each coupled to an opposing end of the base, perpendicular to the base, and extending upwardly from the base, and an opening defined as a planar area within the frame structure between the first and second side supports and the base; a drum disposed within the base of the frame structure; a curtain disposed upon the drum and configured to extend upwardly from the drum by a curtain bar and retract downwardly to the drum; and a drive mechanism configured to extend rapidly the curtain upwardly from the floor surface and retract rapidly the curtain downwardly to the floor surface, to vertically raise and lower the curtain rapidly within the vertical frame structure, thereby to fill the opening when extended and to provide a rapidly extendable and retractable protective barrier.

The roll up guard curtain also can include a first and second carriage assembly coupled to the curtain bar on each of the first and second side supports of the frame structure.

The roll up guard curtain further can include: a first belt vertically disposed within the first side support of the frame structure and coupled to the first carriage assembly; and a second belt vertically disposed within the second side support of the frame structure and coupled to the second carriage assembly. The first belt and the second belt are configured to be maneuvered by the drive mechanism to extend the curtain upwardly from the floor surface and retract the curtain downwardly to the floor surface.

The roll up guard curtain also can include: a first counterweight assembly coupled to the first belt; and a second counterweight assembly coupled to the second belt. The first counterweight assembly and the second counterweight assembly are configured to allow a motion of the curtain to cease when an obstruction to the extension or retraction of the curtain is detected.

The roll up guard curtain further can include: a first pulley assembly over which the first belt coupled to the first counterweight assembly rotates; and a second pulley assembly over which the second belt coupled to the second counterweight assembly rotates.

The roll up guard curtain also can include: a first vertical guide disposed within the first side support of the frame structure; and a second vertical guide disposed within the second side support of the frame structure. The first vertical guide and the second vertical guide are configured to guide movement and operation of the first and second belts over the first and second pulley assemblies and guide movement and operation the first and second counterweight assemblies.

The roll up guard curtain further can include a proximity switch disposed upon the vertical frame structure and configured to identify a current position of the curtain.

The roll up guard curtain also can include a latching mechanism configured to prevent an opening of the curtain by an operator when the curtain is in an up position.

The roll up guard curtain further can include an electric pull solenoid. In this embodiment, the latching mechanism is actuated by the electric pull solenoid to prevent the opening of the curtain by the operator when the curtain is in an up position.

The roll up guard curtain also can include an operator interface by which an operator to control operation of the roll up guard curtain.

The roll up guard curtain further can include a step guard defined by a lower cover that covers the base, drum, and curtain when the curtain is retracted such that the roll up guard curtain is protected from adverse contact.

The drive mechanism of the roll up guard curtain can further include an electric motor and a gearbox. The electric motor and the gearbox are configured to extend rapidly the curtain upwardly from the floor surface and retract rapidly the curtain downwardly to the floor surface, to vertically raise and lower the curtain rapidly within the vertical frame structure, thereby to fill the opening when extended and to provide the rapidly extendable and retractable protective barrier.

In another exemplary embodiment, the technology described herein provides a retractable protective barrier device. The retractable protective barrier device includes: a vertical frame structure having a base configured for disposition on a floor surface, a first side support and a second side support each coupled to an opposing end of the base, perpendicular to the base, and extending upwardly from the base, and an opening defined as a planar area within the frame structure between the first and second side supports and the base; a drum disposed within the base of the frame structure; a roll up guard curtain disposed upon the drum and configured to extend upwardly from the drum by a curtain bar and retract downwardly to the drum; a drive mechanism configured to extend rapidly the curtain upwardly from the floor surface and retract rapidly the curtain downwardly to the floor surface, to vertically raise and lower the curtain rapidly within the vertical frame structure, thereby to fill the opening when extended and to provide a rapidly extendable and retractable protective barrier; a latching mechanism configured to prevent an opening of the roll up guard curtain by an operator when the curtain is in an up position; and an electric pull solenoid, wherein the latching mechanism is actuated by the electric pull solenoid to prevent the opening of the curtain by the operator when the curtain is in an up position; an electric motor; and a gearbox, wherein the electric motor and the gearbox are configured to extend rapidly the curtain upwardly from the floor surface and retract rapidly the curtain downwardly to the floor surface, to vertically raise and lower the curtain rapidly within the vertical frame structure, thereby to fill the opening when extended and to provide the rapidly extendable and retractable protective barrier.

The retractable protective barrier device also can include: a first and second carriage assembly coupled to the curtain bar on each of the first and second side supports of the frame structure; a first belt vertically disposed within the first side support of the frame structure and coupled to the first carriage assembly; and a second belt vertically disposed within the second side support of the frame structure and coupled to the second carriage assembly. The first belt and the second belt are configured to be maneuvered by the drive mechanism to extend the curtain upwardly from the floor surface and retract the curtain downwardly to the floor surface.

The retractable protective barrier device further can include: a first counterweight assembly coupled to the first belt; and a second counterweight assembly coupled to the second belt; a first pulley assembly over which the first belt coupled to the first counterweight assembly rotates; a second pulley assembly over which the second belt coupled to the second counterweight assembly rotates; a first vertical guide disposed within the first side support of the frame structure; and a second vertical guide disposed within the second side support of the frame structure. The first counterweight assembly and the second counterweight assembly are configured to allow a motion of the curtain to cease when an obstruction to the extension or retraction of the curtain is detected. The first vertical guide and the second vertical guide are configured to guide movement and operation of the first and second belts over the first and second pulley assemblies and guide movement and operation the first and second counterweight assemblies.

The retractable protective barrier device also can include a proximity switch disposed upon the vertical frame structure and configured to identify a current position of the curtain.

The retractable protective barrier device further can include an operator interface by which an operator to control operation of the roll up guard curtain.

The retractable protective barrier device also can include a step guard defined by a lower cover that covers the base, drum, and curtain when the curtain is retracted such that the roll up guard curtain is protected from adverse contact.

In various embodiments, the curtain is fabric, plastic, or like material, so long as the material is durable for repeated and frequent use. Additionally, the curtain is of sufficient strength to protect a worker from welding sparks, arc rays, and automated equipment.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the technology described herein. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides an improved roll up guard curtain to protect a worker in an enclosed work area as a protective barrier device.

This device is a barrier protecting device to keep, for example, factory workers guarded from welding sparks, arc rays and automated equipment. The roll up guard curtain rolls up a fabric or plastic curtain vertically from the floor level with an electric motor and gear drive. The roll up guard curtain not only can cover a large area but also quickly retract to allow parts being welded to be removed easily with an overhead hoist. The roll up guard curtain has a latching mechanism to prevent the curtain from being opened by the operator when in the up position.

The technology described herein solves the problem of quickly covering a large area to guard workers from dangerous equipment. This novel technology allows the use of an overhead hoist for unobstructed movement of heavy objects in an out of the work area. When in the down position the roll up guard curtain allows for the easy entry into the work area to load and unload parts. When raised the roll up guard curtain solves a safety issue of people being injured by the upward motion of the curtain because of the way the curtain is raised by counter weighting.

Referring now to the Figures, in various exemplary embodiments, the technology described herein provides a roll up guard curtain assembly 10 is shown. The roll up guard curtain assembly 10 includes a vertical frame structure having a base configured for disposition on a floor surface. The roll up guard curtain assembly 10 is constructed to have a very low profile on the floor surface to minimize workplace disruption and reduce trip hazards in the workplace. The roll up guard curtain assembly 10 includes a first side support and a second side support each coupled to an opposing end of the base and perpendicular to the base. The first and second side supports extend upwardly from the base. An opening is defined as a planar area within the frame structure between the first and second side supports and the base. This is the opening into which the curtain 12 is raised to provide a protective barrier device.

Figure 1:
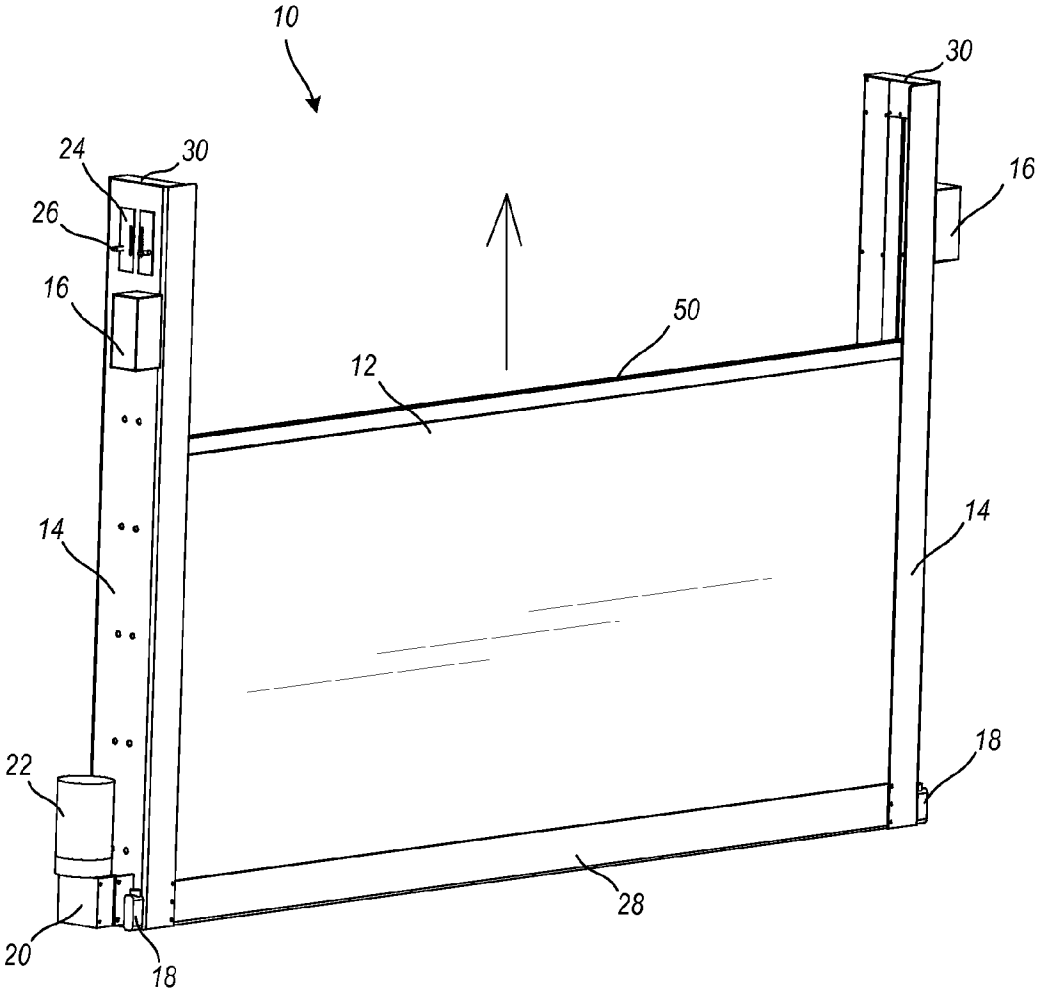
FIG. 1 is a front perspective view of a roll up guard curtain, illustrating, in particular, the curtain in an extended position, according to an embodiment of the technology described herein.
Figure 2:
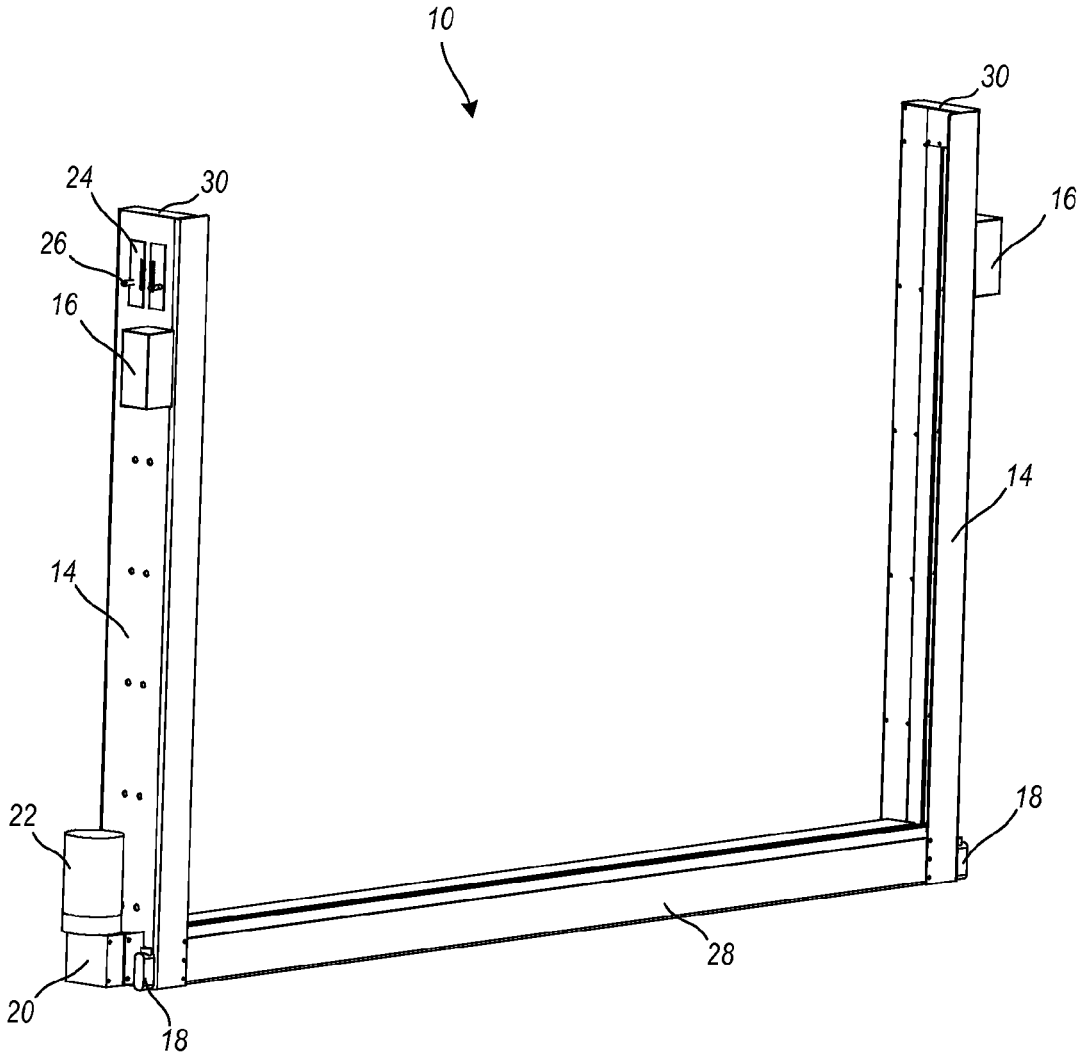
FIG. 2 is a front perspective view of the roll up guard curtain depicted in FIG. 1, illustrating, in particular, the curtain in a retracted position, according to an embodiment of the technology described herein.
Figure 3:
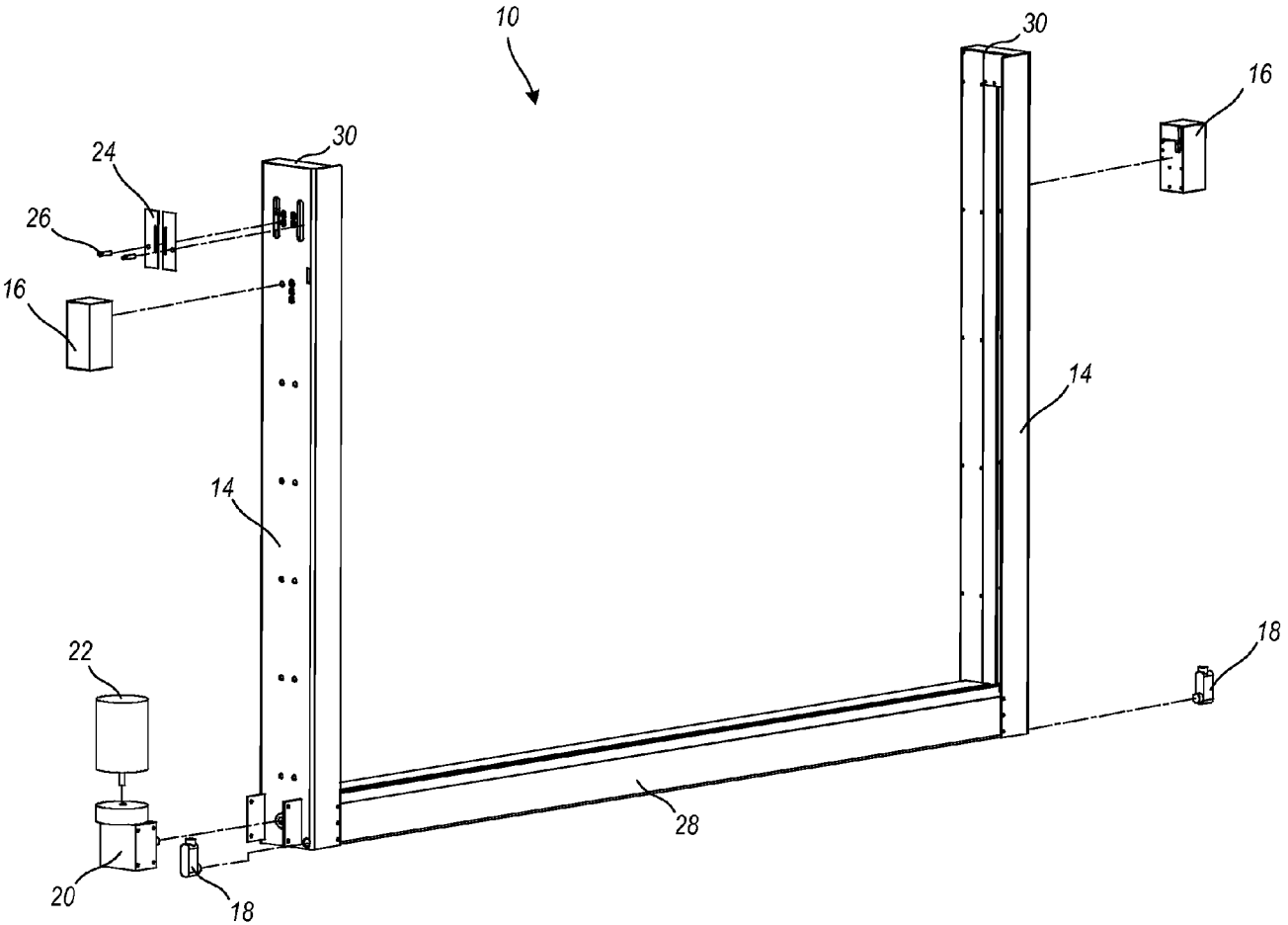
FIG. 3 is front expanded perspective view of the roll up guard curtain depicted in FIG. 1, illustrating, in particular, the curtain in a retracted position.
Figure 5:
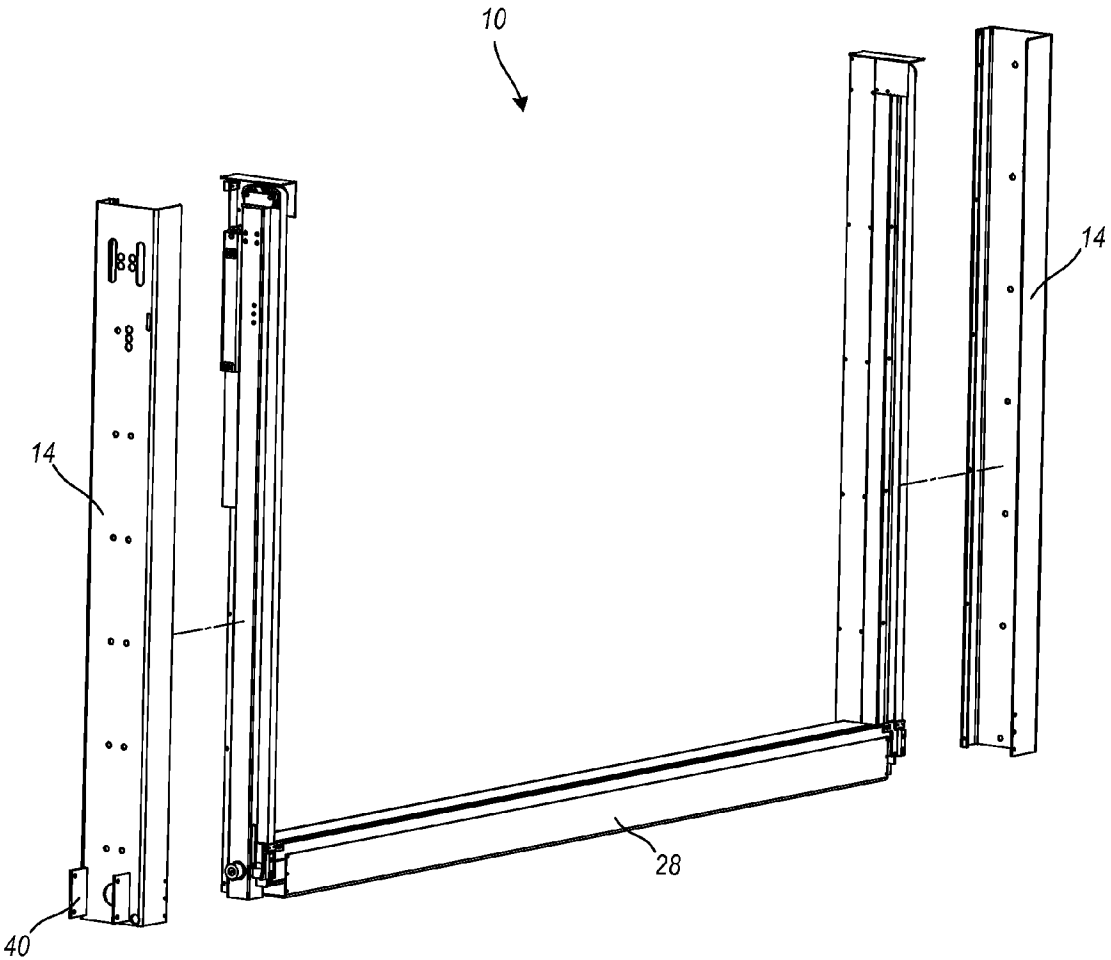
FIG. 5 is a front perspective view of the roll up guard curtain, illustrating, in particular, the side covers and gear box mount, according to an embodiment of the technology described herein.
Figure 6:
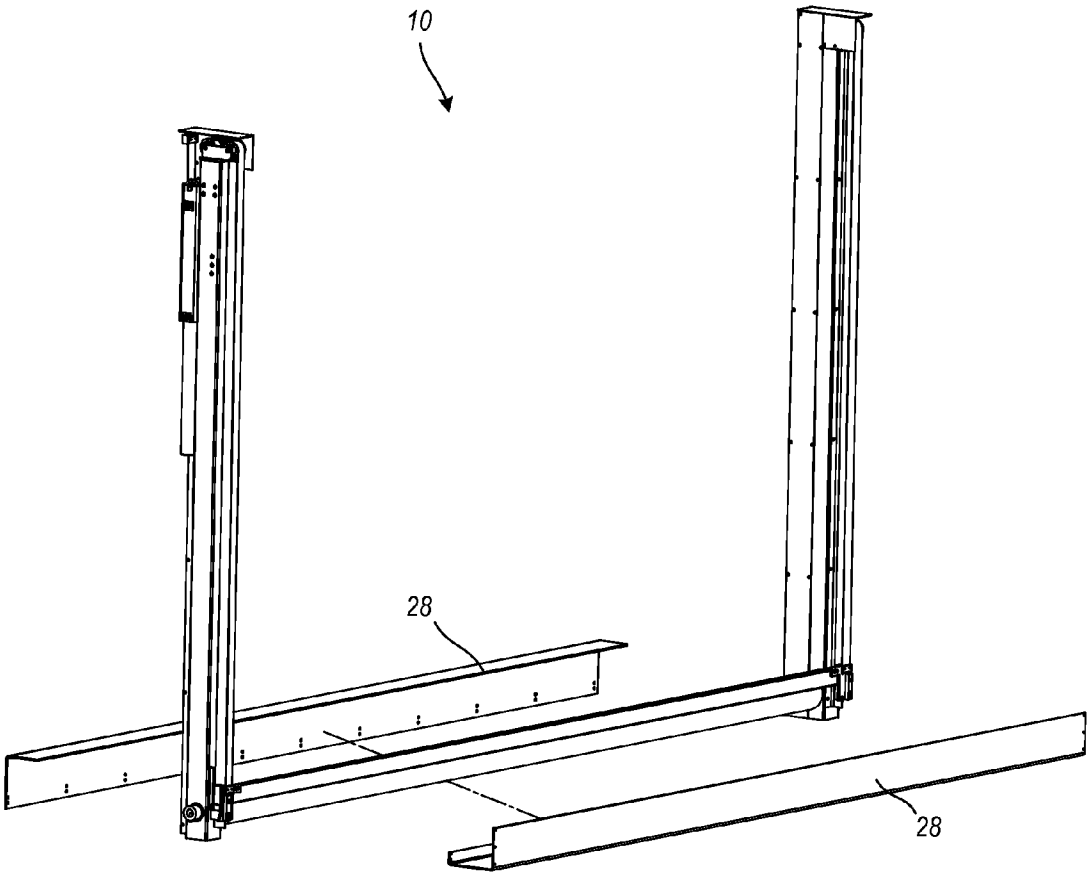
FIG. 6 is a front perspective view of the roll up guard curtain, illustrating, in particular, the lower covers, according to an embodiment of the technology described herein.
Figure 7:
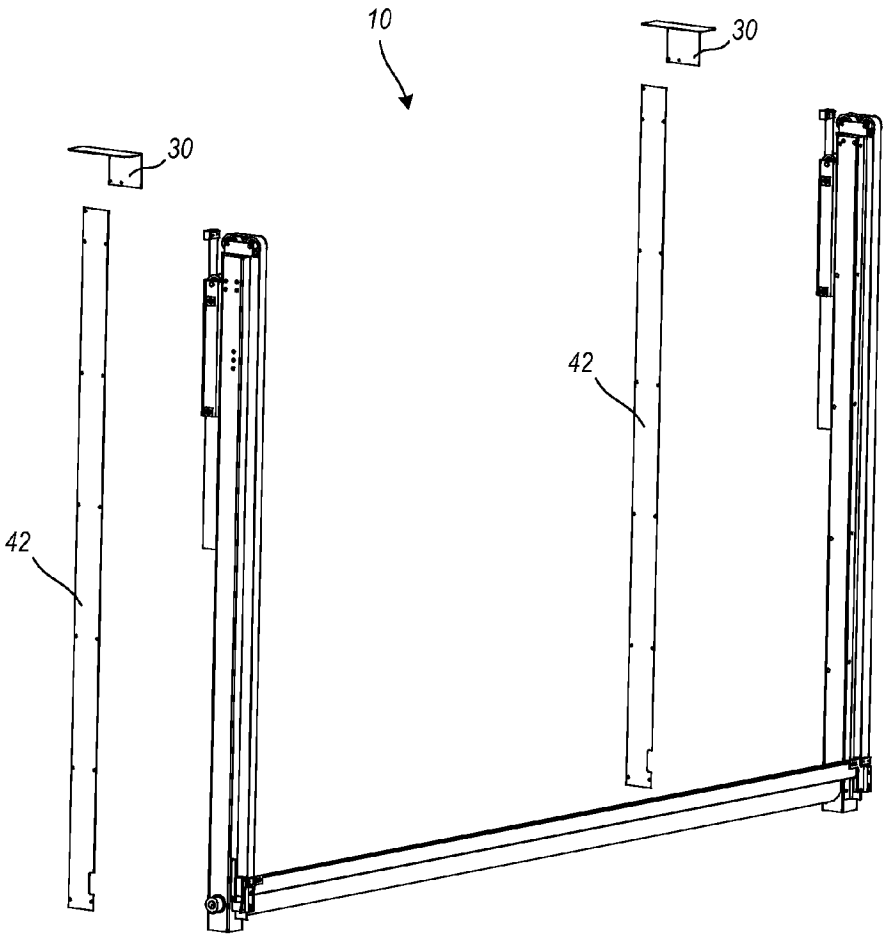
FIG. 7 is a front perspective view of the roll up guard curtain, illustrating, in particular, the top covers and the counter weight covers, according to an embodiment of the technology described herein.

In various embodiments, the roll up guard curtain assembly 10 includes various protective covers to protect the mechanized actions of the device, thereby protecting both the equipment and workers nearby. The first and second side supports extending upwardly from the base are protected by side covers 14 and top covers 30. Lower covers 28 provide protection to the base, drum, and curtain. The lower covers 28 are best illustrated in FIG. 6, the expanded view. The top covers 30 are best illustrated in FIG. 7, the expanded view. The side covers 14 are depicted in FIGS. 1, 2, and 3 and shown removed in FIG. 5. The counterweight assemblies are protected by counterweight covers 42. The counterweight covers 42 are depicted in the expanded view of FIG. 7.

The roll up guard curtain assembly 10 includes a drum 48 disposed within the base of the frame structure. In at least one embodiment, the drum 48 has a height of approximately four inches in diameter at the bottom of the opening. This reduces the step over height significantly. The roll up guard curtain further can include a step guard defined by a lower cover that covers the base, drum 48, and curtain 12 when the curtain 12 is retracted such that the roll up guard curtain 10 is protected from adverse contact. As depicted in the Figures, the step is defined by lower covers 28 which join to form a rigid step. Specifically in FIG. 6, the expanded view of the lower covers 28 shows the shape of the covers and the provision of such as a step when joined one to another over the base of the frame structure.

The roll up guard curtain assembly 10 includes a curtain 12 disposed upon the drum 48 and configured to extend upwardly from the drum 48 by a curtain bar 50 and retract downwardly to the drum. In various embodiments, the curtain 12 is fabric, plastic, or like material, so long as the material is durable for repeated and frequent use. Additionally, the curtain 12 is of sufficient strength to protect a worker from welding sparks, arc rays, and automated equipment. As depicted specifically in FIG. 1, the curtain 12 is shown in an extended position and shown with the direction of extension. As depicted specifically in FIG. 2, the curtain 12 is shown in a retracted position to within the drum 48 and covered by lower step covers 28.

The roll up guard curtain assembly 10 includes a drive mechanism. The drive mechanism is configured to extend rapidly the curtain 12 upwardly from the floor surface and retract rapidly the curtain 12 downwardly to the floor surface. The drive mechanism is configured to vertically raise and lower the curtain rapidly within the vertical frame structure, thereby to fill the opening when extended and to provide a rapidly extendable and retractable protective barrier. The drive mechanism is an assembly of several components discussed below.

In various embodiments, the drive mechanism includes an electric motor 22 and a gearbox 20. The electric motor 22 and the gearbox 20 are configured to extend rapidly the curtain 12 upwardly from the floor surface and retract rapidly the curtain 12 downwardly to the floor surface, to vertically raise and lower the curtain rapidly within the vertical frame structure, thereby to fill the opening when extended and to provide the rapidly extendable and retractable protective barrier. Electrical components and wiring are stored in conduit boxes 18. The electric motor 22 and the gearbox 20 can be controlled, for example, through switch panel 24. The gearbox 20 can be mounted to one of the side supports of the frame at gear box mount 40. The gear box mount 40 is depicted specifically in FIG. 5.

Figure 8:
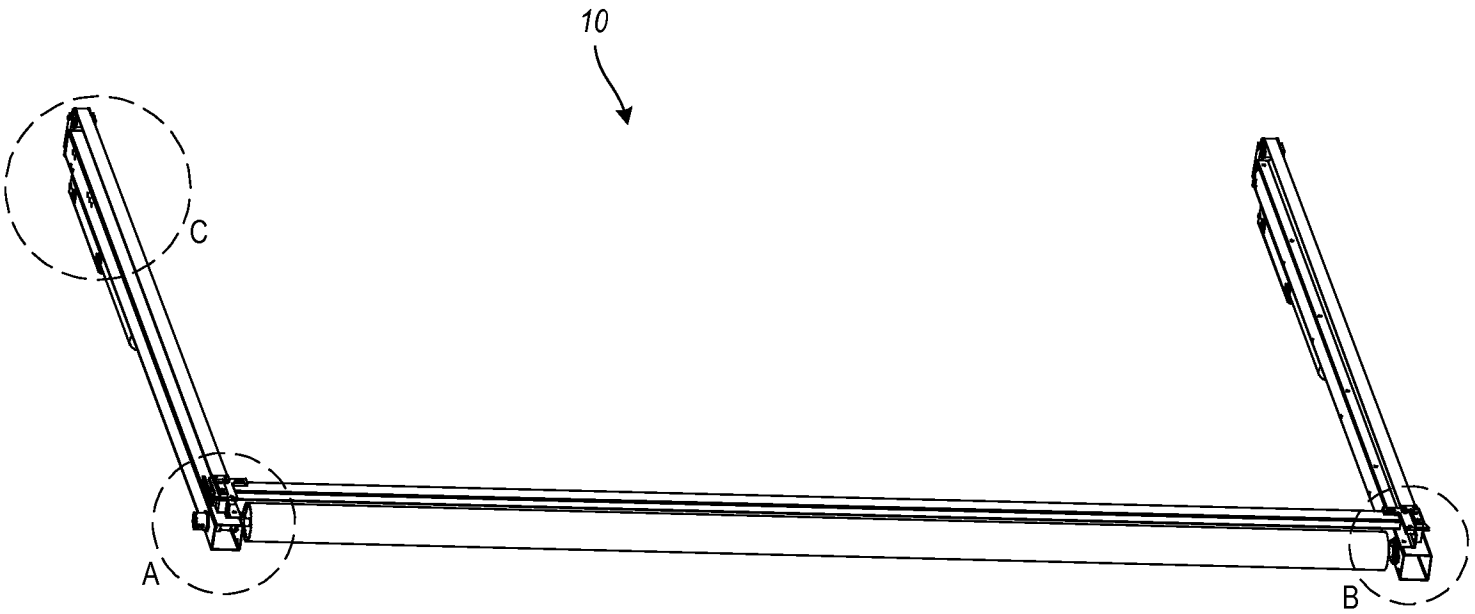
FIG. 8 is a bottom perspective view of the roll up guard curtain with the side covers, lower covers, top covers, and counter weight covers removed.
Figure 9:
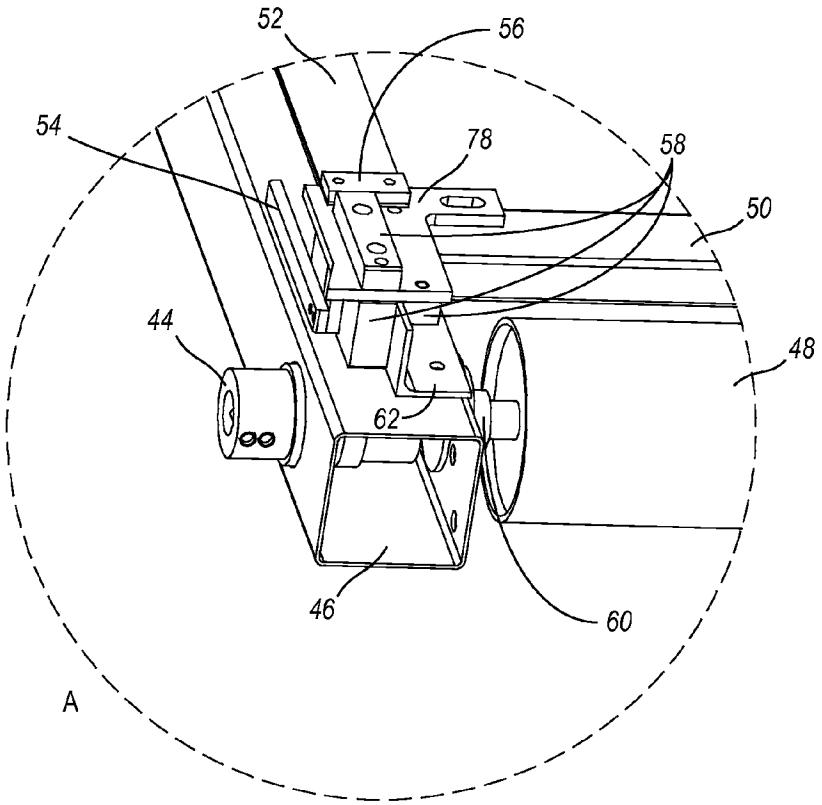
FIG. 9 is a close up view of the support tube, roll up drum, curtain bar, belt, and sensor switch actuator, according to an embodiment of the technology described herein.
Figure 11:
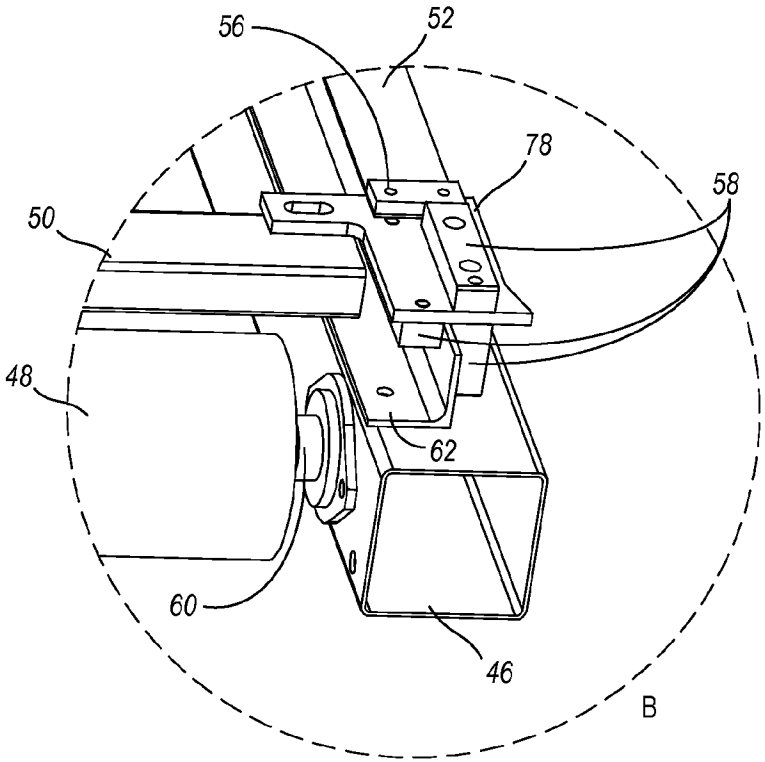
FIG. 11 is a close up view of the support tube, roll up drum, curtain bar, and belt.
Figure 12:
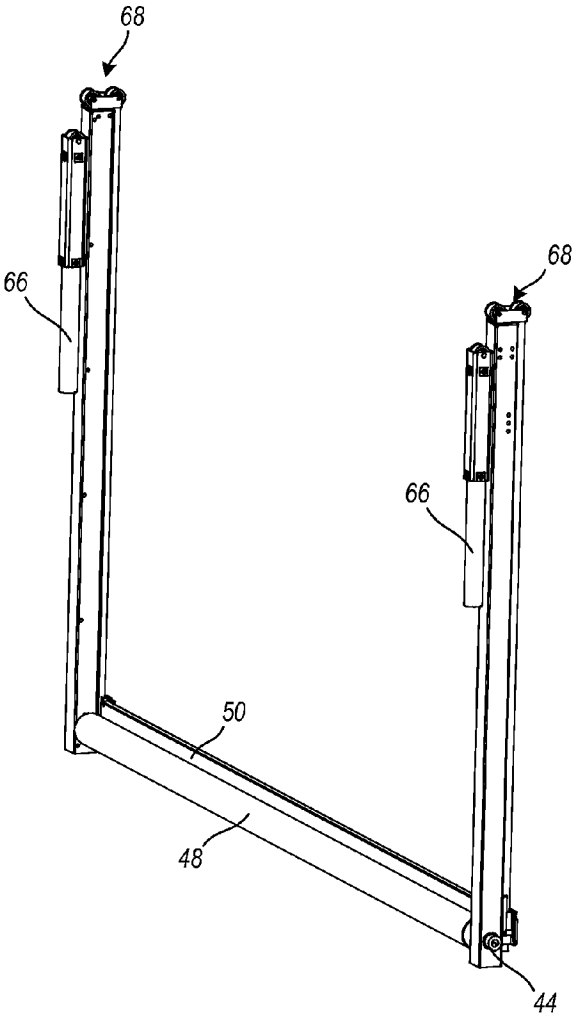
FIG. 12 is a front perspective view of the counter weight assemblies, according to an embodiment of the technology described herein.
Figure 13:
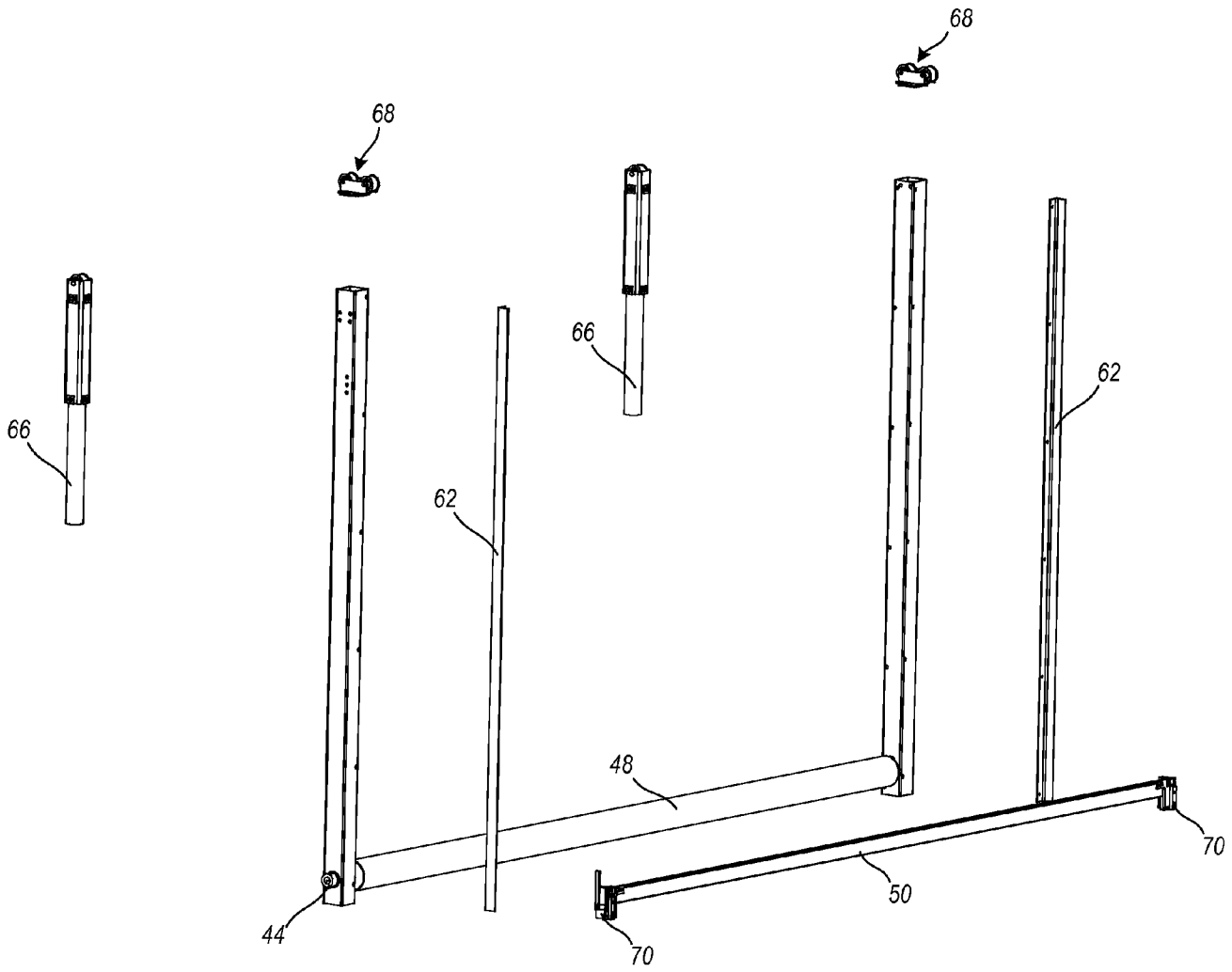
FIG. 13 is an expanded front perspective view of the counter weight assemblies.

The roll up guard curtain assembly 10 includes first and second carriage assemblies 70 with carriage 78 coupled to the curtain bar 50 on each of the first and second side supports of the frame structure. The carriages 70 are depicted in FIGS. 8, 9, and 11. The carriages 78 are within areas A and B in FIG. 8. Each carriage 78 includes the belt clamp 56 which secures a belt 52 to the carriage 78. Each carriage 78 includes blocks 58, such as plastic guide wear blocks 58 to aid movement along the angle carriage guide 62 as the curtain 12 is raised and lowered. The angle carriage guide 62 is secured to support tube 46. The support tube 46 also secures the drum 48. The drum 48 is secured with roller ball bearings 60 and flexible shaft coupling 44. The carriages 78 also provide an attachment means for sensor/switch actuators 54, which are configured to sense a curtain 12 location and actuate the movement of the curtain 12.

The roll up guard curtain assembly 10 includes a first belt 52 vertically disposed within the first side support of the frame structure and coupled to the first carriage assembly 78 and a second belt 52 vertically disposed within the second side support of the frame structure and coupled to the second carriage assembly 78. The first and second belts 52 are configured to be maneuvered by the drive mechanism to extend the curtain upwardly from the floor surface and retract the curtain downwardly to the floor surface. In at least one embodiment, the first and second belts 52 are nylon strap belts.

Figure 10:
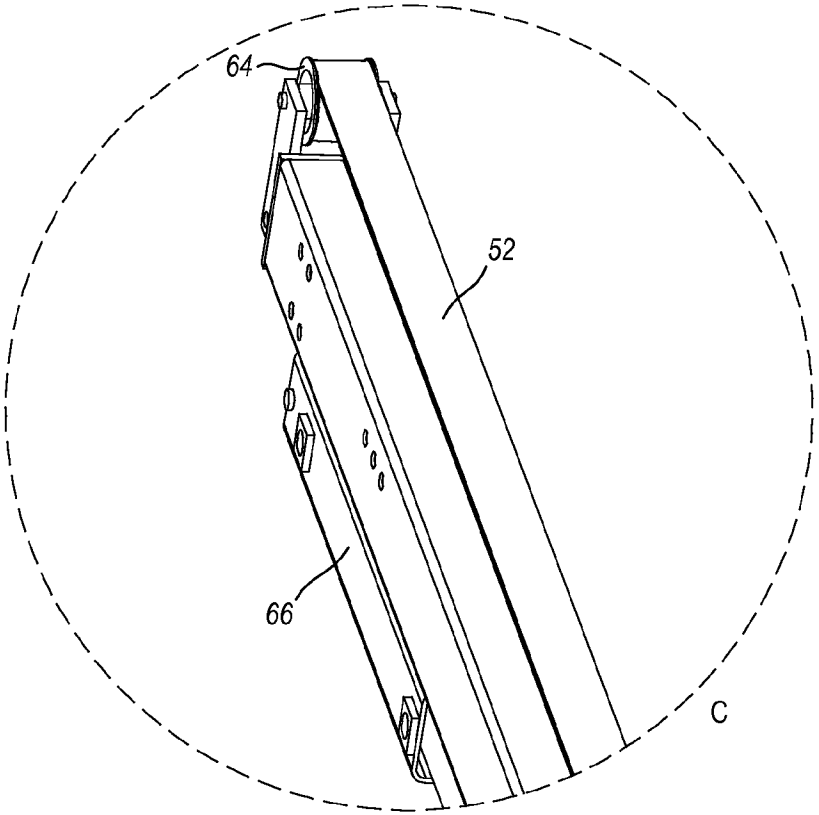
FIG. 10 is a close up view of the idler pulley, belt, and counter weight, according to an embodiment of the technology described herein.
Figure 14:
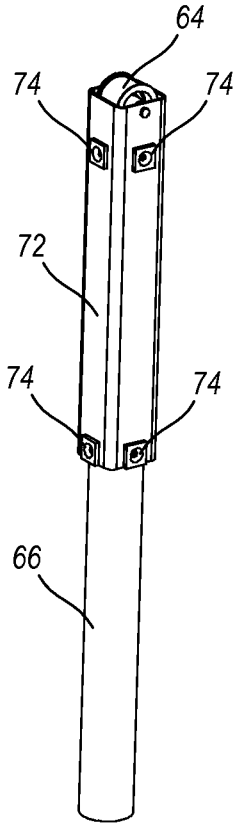
FIG. 14 is a front perspective view of a counter weight.
Figure 15:
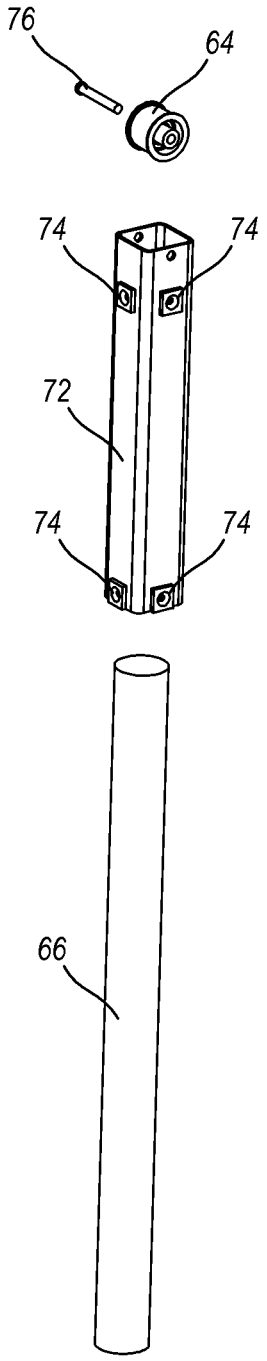
FIG. 15 is a expanded front perspective view of a counter weight.
Figure 16:
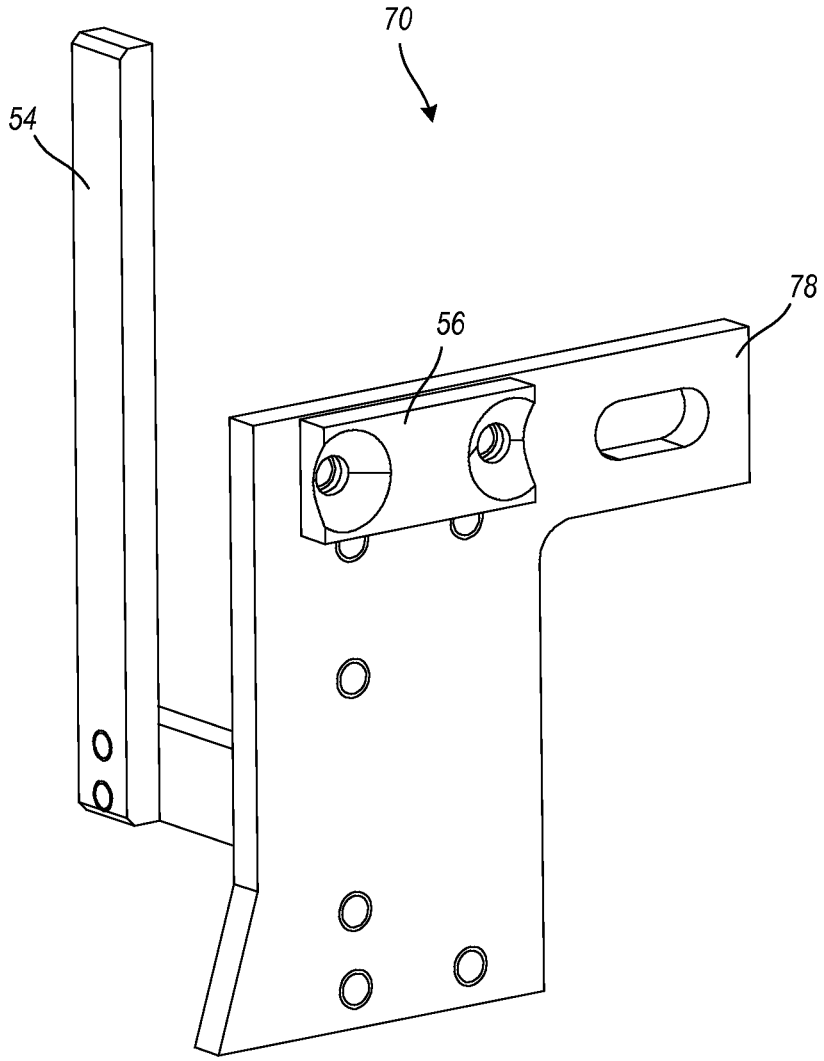
FIG. 16 is a front perspective view of a carriage assembly, according to an embodiment of the technology described herein.

The roll up guard curtain assembly 10 includes counterweight assemblies. A counter weight assembly is depicted as area C in FIGS. 8 and 10 and specifically depicted in FIGS. 14 and 15. In one embodiment, the roll up guard curtain assembly 10 includes a first counterweight assembly coupled to the first belt 52 and a second counterweight assembly coupled to the second belt 52. The first counterweight assembly and the second counterweight assembly are configured to allow a motion of the curtain 12 to cease when an obstruction to the extension or retraction of the curtain 12 is detected. Each counterweight assembly includes a counterweight 66, sleeve 72, and pads 74 disposed upon the sleeve 72. The sleeve 72 holds the counterweight 66. The pads 74 provide guidance and wear resistance to the sleeve 72 as it is raised and lowered, opposite to the direction of the curtain 12 movements. The sleeve 72 also contains pulley 64, coupled to the sleeve 72 with a clevis pin 76.

The roll up guard curtain assembly 10 includes a first pulley assembly 68, such as having an idler pulley 64, over which the first belt 52 coupled to the first counterweight assembly rotates and a second pulley assembly 68 over which the second belt 52 coupled to the second counterweight assembly rotates.

The roll up guard curtain assembly 10 includes a first vertical guide 62 disposed within the first side support of the frame structure and a second vertical guide 62 disposed within the second side support of the frame structure. The first and second vertical guides 62 are configured to guide movement and operation of the first and second belts 52 over the first and second pulley assemblies 68 and guide movement and operation the first and second counterweight assemblies.

The roll up guard curtain assembly 10 includes a proximity switch 26 disposed upon the vertical frame structure. The proximity switch 26 is configured to identify a current position of the curtain 12.

Figure 4:
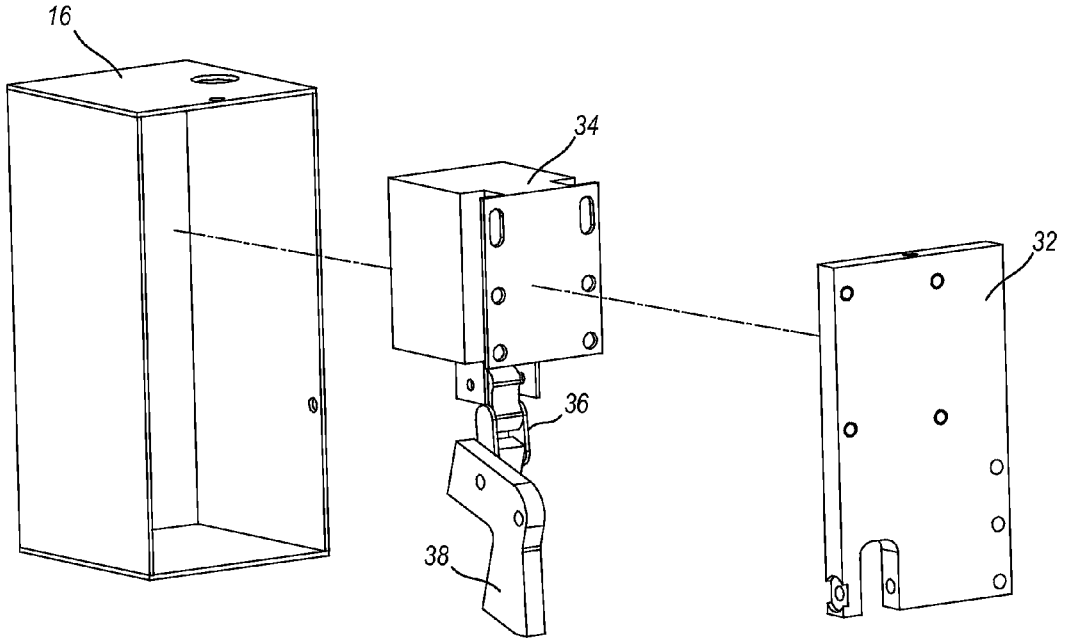
FIG. 4 is an front perspective view of a latch assembly, according to an embodiment of the technology described herein.

The roll up guard curtain assembly 10 includes include a latching mechanism configured to prevent an opening of the curtain 12 by an operator when the curtain 12 is in an up position. Latch cover box 16 is shown in FIG. 1. The latching mechanism is depicted specifically in FIG. 4.

The roll up guard curtain assembly 10 includes an electric pull solenoid 34 coupled to latch base 32. In this embodiment, the latching mechanism is actuated by the electric pull solenoid 34 to prevent the opening of the curtain 12 by the operator when the curtain 12 is in an up position. The latch 38 is coupled to the electric pull solenoid 34 by link 36. The link 36 is a roller chain link in at least one embodiment.

The roll up guard curtain assembly 10 includes an operator interface by which an operator to control operation of the roll up guard curtain. By way of example the operator interface is switch plate 24.

In use, and by way of example, the roll up guard curtain assembly 10 can be manufactured from the following process steps:

- Fabricate a steel hollow drum with an outer tube sized at 4" with 2 inner shafts of ¾" diameter;
- Fabricate two side frames and guides systems from steel;
- Fabricate a top curtain rod bar from steel;
- Fabricate a motor mount from steel;
- Fabricate a latch mechanism from steel;
- Provide a fabric curtain sewn with Velcro® hooks-and-loop fasteners attaching on the bottom and a loop on the top;
- Provide motor, gearbox, roller bearings, belts, motor drive, solenoid for latch, and other required wires, switches and parts;
- Assemble the side frames to the workstation;
- Assemble the drum and curtain to the frame;
- Assemble the motor and gearbox to the drum;
- Assemble the latch mechanism to the frame;
- Assemble the top curtain rod bar to the curtain;
- Attach the belts and counterweights to the curtain rod bar;
- Hook up all wiring to the motor and control system; and
- Configure the motor controls for the proper acceleration and deceleration.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the technology described herein and are intended to be covered by the following claims.

What is claimed is:

1. A roll up guard curtain comprising:

a floor mounted vertical frame structure having a base disposed directly upon a floor surface and having a low profile relative to the floor surface to minimize trip hazards in a workplace, a first side support and a second side support each coupled to an opposing end of the base at the floor surface, perpendicular to the base, and extending upwardly from the floor at the base, and an opening defined as a planar area within the frame structure between the first and second side supports and the base;

a drum disposed within the base of the frame structure;

a non-segmented fabric guard curtain disposed upon the drum extendable upwardly from the drum at the floor surface by a curtain bar and retractable downwardly to the drum at the floor surface to provide a protective barrier device to protect a worker in a work area and store at the floor surface when not in use;

a step guard consisting of a pair of lower covers, each cover to cover generally two adjacent, perpendicular sides of a square such that collectively the pair covers the base, drum, and fabric guard curtain at the low profile to the floor surface when the curtain is retracted such that the roll up guard curtain is protected from adverse contact;

an electric motor; and a gearbox;

wherein the electric motor and the gearbox are disposed on the floor surface adjacent to the base to provide an electric drive mechanism configured to extend automatically the fabric guard curtain upwardly from the floor surface and retract automatically the curtain downwardly to the floor surface, to vertically raise and lower the fabric guard curtain automatically within the vertical frame structure, thereby to fill the opening when extended and to provide an extendable and retractable protective barrier;

a proximity switch disposed upon the vertical frame structure and configured to identify a current position of the curtain;

an electric pull solenoid;

a latching mechanism to prevent a lowering of the fabric guard curtain by an operator when the fabric guard curtain is in an up position, and wherein the latching mechanism is actuated by the electric pull solenoid to prevent the lowering of the fabric guard curtain by the operator when the fabric guard curtain is in an up position; and an operator interface electric switch plate configured to actuate the electric motor and the gearbox to control operation of the roll up guard curtain;

a first and second carriage assembly coupled to the curtain bar on each of the first and second side supports of the frame structure;

a first belt vertically disposed within the first side support of the frame structure and coupled to the first carriage assembly; and a second belt vertically disposed within the second side support of the frame structure and coupled to the second carriage assembly;

wherein the first belt and the second belt are configured to be maneuvered by the drive mechanism to extend the curtain upwardly from the floor surface and retract the curtain downwardly to the floor surface.

2. The roll up guard curtain of claim 1, further comprising:

a first counterweight assembly coupled to the first belt; and a second counterweight assembly coupled to the second belt;

wherein the first counterweight assembly and the second counterweight assembly are configured to allow a motion of the curtain to cease when an obstruction to the extension or retraction of the curtain is detected.

3. The roll up guard curtain of claim 2, further comprising:

a first pulley assembly over which the first belt coupled to the first counterweight assembly rotates; and a second pulley assembly over which the second belt coupled to the second counterweight assembly rotates.

4. The roll up guard curtain of claim 3, further comprising:

a first vertical guide disposed within the first side support of the frame structure; and a second vertical guide disposed within the second side support of the frame structure;

wherein the first vertical guide and the second vertical guide are configured to guide movement and operation of the first and second belts over the first and second pulley assemblies and guide movement and operation the first and second counterweight assemblies.

5. A retractable protective barrier device comprising:

a floor mounted vertical frame structure having a base disposed directly upon a floor surface and having a low profile relative to the floor surface to minimize trip hazards in a workplace, a first side support and a second side support each coupled to an opposing end of the base at the floor surface, perpendicular to the base, and extending upwardly from the floor at the base, and an opening defined as a planar area within the frame structure between the first and second side supports and the base;

a drum disposed within the base of the frame structure;

a non-segmented roll up guard curtain disposed upon the drum extendable upwardly from the drum at the floor surface by a curtain bar and retractable downwardly to the drum at the floor surface by a curtain bar and retract downwardly to the drum at the floor surface to provide a protective barrier device to protect a worker in a work area and store at the floor surface when not in use;

a step guard consisting of a pair of lower covers, each cover to cover generally two adjacent, perpendicular sides of a square such that collectively the pair covers the base, drum, and fabric guard curtain at the low profile to the floor surface when the curtain is retracted such that the roll up guard curtain is protected from adverse contact;

an electric drive mechanism configured to extend automatically the curtain upwardly from the floor surface and retract automatically the curtain downwardly to the floor surface, to vertically raise and lower the curtain automatically within the vertical frame structure, thereby to fill the opening when extended and to provide an extendable and retractable protective barrier;

a proximity switch disposed upon the vertical frame structure and configured to identify a current position of the curtain;

an electric pull solenoid;

a latching mechanism to prevent a lowering of the fabric guard curtain by an operator when the fabric guard curtain is in an up position, and wherein the latching mechanism is actuated by the electric pull solenoid to prevent the lowering of the fabric guard curtain by the operator when the fabric guard curtain is in an up position;

an electric motor; and a gearbox, wherein the electric motor and the gearbox are disposed on the floor surface adjacent to the base to extend automatically the curtain upwardly from the floor surface and retract automatically the curtain downwardly to the floor surface, to vertically raise and lower the curtain automatically within the vertical frame structure, thereby to fill the opening when extended and to provide the extendable and retractable protective barrier; and an operator interface electric switch plate configured to actuate the electric motor and the gearbox to control operation of the roll up guard curtain;

a first and second carriage assembly coupled to the curtain bar on each of the first and second side supports of the frame structure;

a first belt vertically disposed within the first side support of the frame structure and coupled to the first carriage assembly; and a second belt vertically disposed within the second side support of the frame structure and coupled to the second carriage assembly;

wherein the first belt and the second belt are configured to be maneuvered by the drive mechanism to extend the curtain upwardly from the floor surface and retract the curtain downwardly to the floor surface.

6. The retractable protective barrier device of claim 5, further comprising:

a first counterweight assembly coupled to the first belt;

a second counterweight assembly coupled to the second belt;

wherein the first counterweight assembly and the second counterweight assembly are configured to allow a motion of the curtain to cease when an obstruction to the extension or retraction of the curtain is detected;

a first pulley assembly over which the first belt coupled to the first counterweight assembly rotates;

a second pulley assembly over which the second belt coupled to the second counterweight assembly rotates;

a first vertical guide disposed within the first side support of the frame structure; and a second vertical guide disposed within the second side support of the frame structure;

wherein the first vertical guide and the second vertical guide are configured to guide movement and operation of the first and second belts over the first and second pulley assemblies and guide movement and operation the first and second counterweight assemblies.

7. The retractable protective barrier device of claim 5, wherein the curtain is fabric.

8. The retractable protective barrier device of claim 5, wherein the curtain is plastic.

* * * * *